United States Patent [19]

Seelenbinder

[11] 4,217,016

[45] Aug. 12, 1980

[54] ROTARY ELECTRIC RECEPTACLE

[75] Inventor: Terry G. Seelenbinder, Elk Grove Village, Ill.

[73] Assignee: AM International, Inc., Los Angeles, Calif.

[21] Appl. No.: 3,203

[22] Filed: Jan. 15, 1979

[51] Int. Cl.[2] ..... H01R 39/00

[52] U.S. Cl. ..... 339/5 M; 339/8 R; 339/182 RS

[58] Field of Search ..... 339/5, 6, 8 R, 8 RL, 339/182 RS

[56] References Cited

U.S. PATENT DOCUMENTS 2,967,216 1/1961 Zablocki et al. ..... 339/5 P X 3,058,082 10/1962 Messerli ..... 339/8 A

*Primary Examiner*—Roy Lake

*Assistant Examiner*—DeWalden W. Jones

*Attorney, Agent, or Firm*—A. W. Karambelas; R. S. Hulse

[57] ABSTRACT

A rotary receptacle for supplying electric power to a rotating power-using device includes a nonrotating housing separated into two compartments by a rotary insulating disk. Each face of the disk carries a brush which runs against the interior surface of a slip ring housed within the corresponding compartment and shaped and dimensioned so as to provide maximum spacing between each slip ring and the periphery of the insulating disk.

9 Claims, 6 Drawing Figures

Fig. 3
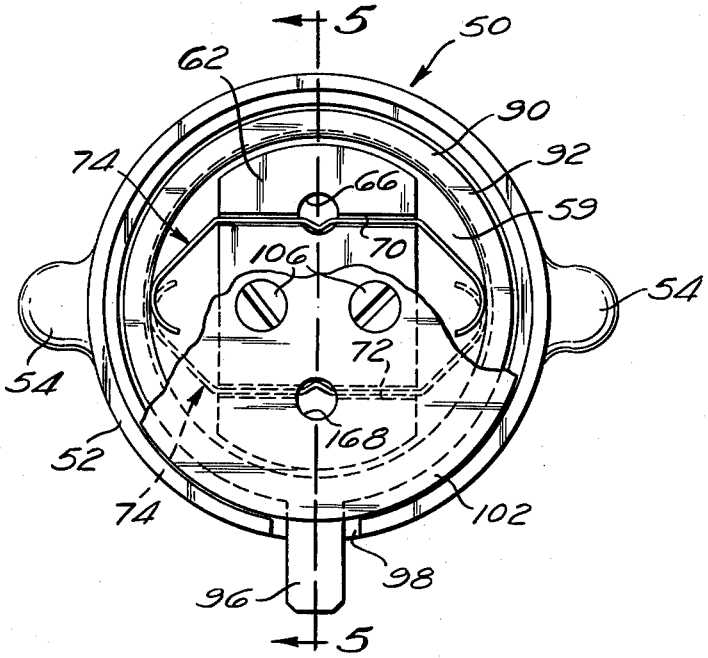
Fig. 5
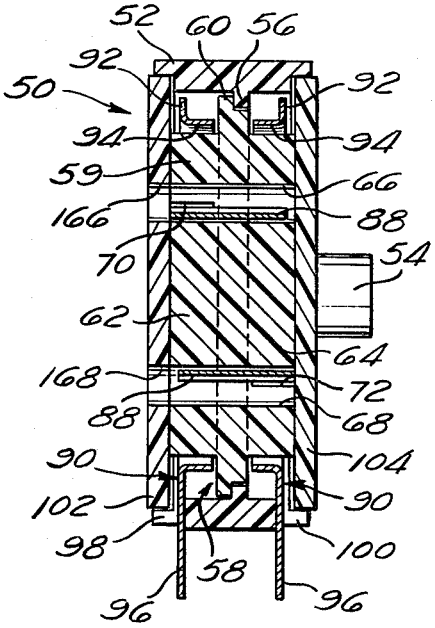
Fig. 6
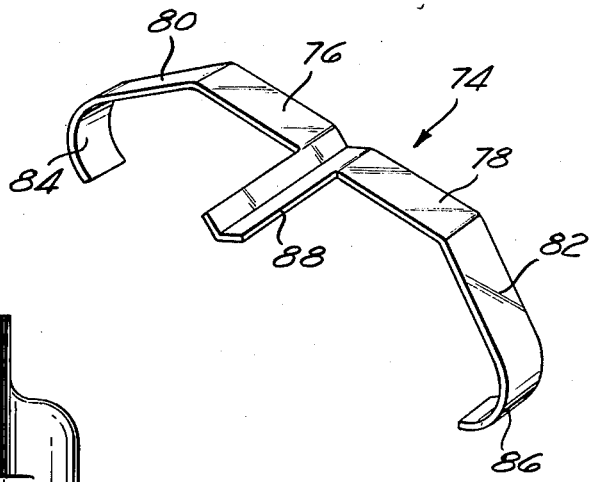
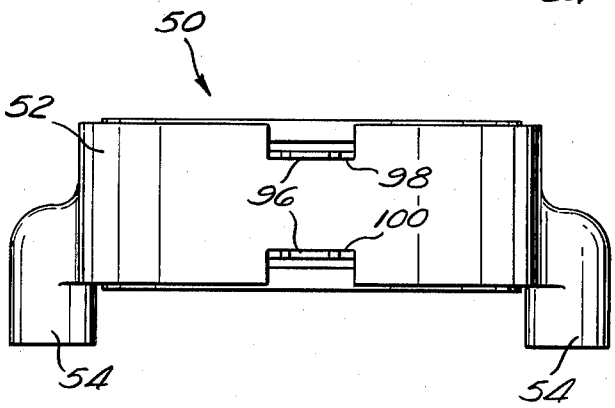
Fig. 4

ROTARY ELECTRIC RECEPTACLE

BACKGROUND OF THE INVENTION

Various practical situations present the need for making electrical connections to a rotating element, and one particular application has to do with providing electrical energy connection to a tubular fluorescent lamp which must rotate on its axis in use. Such an arrangement is illustrated in U.S. Pat. No. 2,875,677 wherein the lamp serves both as the exposure source in a photocopying machine, and also as a roller in the transport system for the copy sheet. Illustrated in that patent is a receptacle having a fixed support portion and a rotor for making contact with the lamp pins, plus slip ring means providing for electrical connection to the lamp pins during the lamp's rotary motion. The device, however, is constructed of a large number of differently shaped parts, expensive both to make and to assemble. Furthermore, the arrangement is such that portions of differing electrical potential in the circuit are in such close proximity by direct air path that a short circuit hazard is present, and extensive change, presumably introducing even more structural complexity, would apparently be required to improve the condition.

SUMMARY OF THE INVENTION

The invention relates to an improved rotary receptacle which is much simpler than those heretofore known, which comprises many fewer parts, some of which are duplicates, and which is thus less costy to fabricate and assemble than the previously known devices. In addition the rotor is essentially an insulating plate which divides the two parts of the circuit, providing an arrangement wherein the free air path between circuit portions of differing electrical potential is substantially greater than heretofore achieved in devices of similar overall dimensions.

DESCRIPTION OF THE DRAWING

In the drawing:

FIG. 3 is a face view of the receptacle of the invention looking at the side from which the lamp contacts are inserted, and with a portion of one cover plate broken away;

FIG. 4 is an edge view of the device of FIG. 3, looking from the bottom in FIG. 3;

FIG. 5 is a section taken on line 5—5 of FIG. 3; and

FIG. 6 is a perspective view of one of the combined contactor and brush elements.

DESCRIPTION OF THE PREFERRED EMBODIMENT

Figure 1:
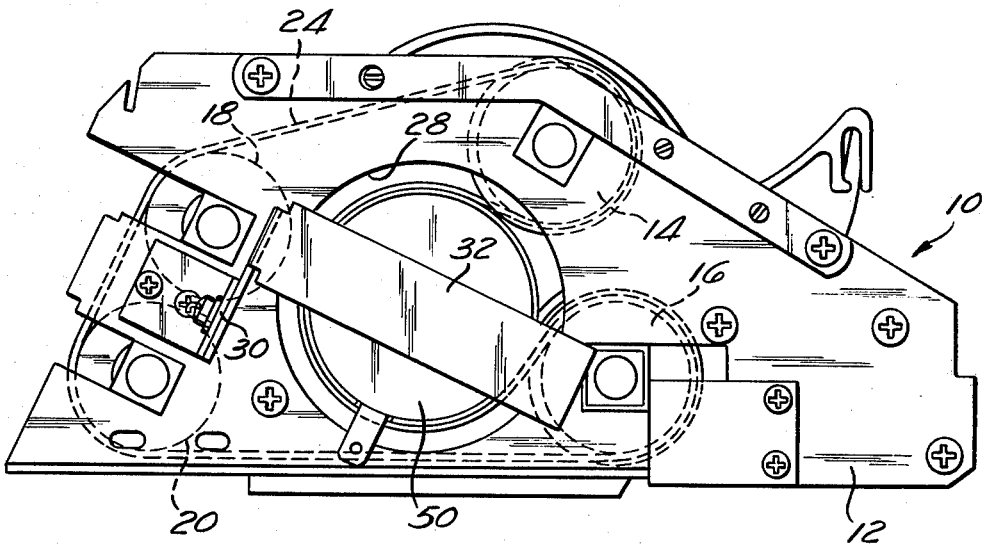
FIG. 1 is a side elevation of the exposure portion of a photocopy device illustrating one application for the rotary receptacle of the invention.

With reference to FIG. 1, there is illustrated the exposure section of a photocopying machine, particularly a diazo copier, which comprises a frame 10 having parallel end plates, only one of which is shown, and designated by the numeral 12. Mounted for rotation in these end plates is a set of four parallel rollers 14, 16, 18 and 20.

At a central location within the group of rollers is flourescent lamp 22 which is arranged parallel to the rollers and in fact acts as a fifth roller. The lamp may be seen in FIG. 2, but is not visible in FIG. 1 because it lies directly behind its receptacle to be presently described. Trained about the rollers 14, 16, 18, 20 and lamp 22 are sets of belts such as belt 24 shown in FIG. 1. This belt embraces the lamp 22 and, since the latter is floatingly mounted, draws the lamp towards contact with rollers 14 and 16. This may occur by virtue of the resiliency of the belts, or it may occur either by having the position of one of the four rollers adjustable or by having one of the rollers resiliently mounted so as to act as a belt tightener in a customary manner.

One or more of the rollers is powered in a conventional manner (not shown) to cause the belts 24 to rotate the lamp 22 and to progressively feed a copy sheet and an original against the surface of the lamp to effect a contact exposure as is conventionally done.

Figure 2:
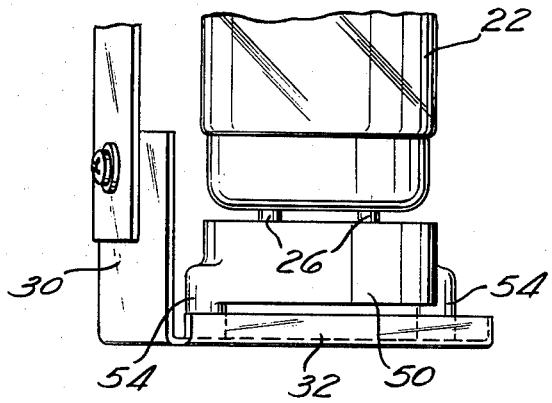
FIG. 2 is a fragmentary top view of the device of FIG. 1, showing the receptacle, the mounting bracket therefor and its connection with one end of a fluorescent lamp.

In order to energize the lamp while it is rotating there are provided rotary receptacles, one at each end of the lamp, for making contact with the connector pins 26 of the lamp (see FIG. 2). Only one of these receptacles is illustrated since they are identical, and the reference character 50 identifies this receptacle. As can be seen in FIG. 2, the lamp 22 is slightly longer than the four rollers and projects through an opening 28 in each end plate. A support bracket 30 is mounted on each end plate and carries as a part thereof a guide channel 32 with which the receptacle 50 is slidingly associated in a manner which will presently be described.

The rotary receptacle 50 of the present invention is illustrated in detail in FIGS. 3 to 6 and comprises a housing 52 which is the primary non-rotating member of the assembly. The housing is constructed of insulating material and carries integral diametrically positioned exterior bosses 54, 54 which are slidably arranged in the guide channel 32 where they act to prevent rotation of the housing and at the same time to allow shifting of the lamp so as to assume an appropriate functioning relationship with the rollers 14 and 16.

The housing 52 has an integral internal guide ring 56 which assists in positioning an internal rotary member or rotor 58. The rotor comprises essentially a disk 59 of insulating material which divides the housing into two substantially noncommunicating compartments and loosely fits the housing so as to be rotationally supported and guided thereby. At its circumference is a lip 60 designed to overlie and run against the guide ring 56 to centrally position the rotor during assembly. On either face of the disk 59 is an integral broad raised island or boss one of which is designated 62 and the other 64 (FIG. 5). These islands are of course of the same insulating material as the disk 59.

The rotor is drilled in two places to provide openings 66 and 68 equally spaced from the disk axis and positioned with proper spacing from each other to receive the lamp connector pins 26, 26.

As seen in FIGS. 3 and 5, the island 62 has a narrow slot 70 intersecting the opening 66, and the island 64 has a similar slot intersecting the opening 68. Cooperating with each opening and slot is a combined brush and contactor element stamped and formed from a thin strip of resilient conductive metal.

The contactor element is designated by reference character 74 and is best seen in its entirety in FIG. 6. The element comprises two straight retaining sections 76 and 78 which fit rather snugly into the portions of slot 70 or 72 at either side of the respective opening. Arms 80 and 82 extend from the retaining sections and end in curved tips 84 and 86 respectively which act as brushes. Centrally of the member 74, and extending from one side thereof in a perpendicular direction, is a shallow trough shaped blade 88 designed to enter the respective opening 66 or 68 and act as a friction contactor for making electrical connection with one of the lamp pins 26.

FIG. 3 illustrates how the two combination elements 74 are each slipped into one of the slots 70 and 72, and FIG. 5 illustrates how the blade 88 of each element is positioned within its respective opening 66 or 68, ready to make contact with a lamp connector pin 26.

Received within the housing 52 and surrounding the island 62 is a slip ring 90 which preferably has a radial flange 92 and an axial cylindrical ring 94 (FIG. 5). The former serves to center the ring roughly in the circular housing opening while the latter contacts the brushes and also provides an approximate axial fit to prevent cocking during assembly. As seen in FIG. 5 both the flange and the cylindrical ring are arranged to be disposed as remotely as possible from the faces at the sliding joint between the ring 56 and the lip 60. In particular the axial ring 94 is significantly smaller than the periphery of the disk 59 and is held approximately centered with respect to the disk periphery by the flange 92. At the same time the flange is retained in a position spaced from the disk by the presence of the ring. Integrally projecting from one portion of the radial flange 92 is connector tab 96 for making a soldered or other connection with the energizing circuit. As can also be seen in FIG. 5, an identical slip ring 90 surrounds the island 64 on the other side of the disk 58. The first slip ring is arranged with its tab projecting through a suitable slot 98 provided in the housing 52, and the second with its tab projecting through a similar slot 100 on the opposite side. The slip rings have a rather loose fit with all of the surrounding parts and each is held roughly centered by coaction with the resilient opposite acting brush arms of its combined brush/contactor element 74.

The faces of the receptacle are closed by two cover disks which are also of insulating material. The cover disk 102 is on the side of the housing which receives the lamp pins and is provided with two openings 166 and 168 matching the pin receiving openings 66 and 68 in the rotor 58. The cover disk 104 is on the opposite face. Aligned openings are provided in the two disks 102, 104 and the rotor 58 to receive fasteners such as screws 106 which may, for example, have a threaded connection with the openings in plate 104 whereby to unite the two plates and the rotor into a single rotary member.

It will be understood that when the parts are assembled as shown in FIGS. 3 and 5, the nonrotary portions of the assembly are the housing 52 and the slip rings 90, 90 with their tabs 96, 96. The rotary portion of the assembly includes the rotor 58 which carries the islands 62 and 64 and combined brush and contact elements 74, 74. It is pointed out that the thickness of the rotor 58, including the two islands, is so selected that when the cover plates 102 and 104 are firmly fastened to its faces, the spacing between them is just slightly greater than the axial dimension of the housing 52 so that the housing will not be clamped by the disks and the rotary assembly is permitted to turn with little frictional resistance other than that offered by the brushes running against the slip rings.

From the foregoing description it can be seen that the present invention provides a rotary receptacle which requires a minimum number of parts, the form shown having only eight parts (exclusive of fasteners), four of the parts being two identical pairs, namely the slip rings and the combined brush/contactor elements. All of the parts are so configured as to be readily constructed by molding or stamping.

In addition, the arrangement of parts is such that, even though the receptacle is of minimum axial dimension, the short circuit risk is essentially obviated. The minimum air path between circuit portions which are of differing electrical potential can be made fully adequate without unduly enlarging the receptacle. For instance a device in accordance with the present showing, built on a scale providing a two inch housing diameter and an eleven-sixteenth inch axial dimension would have a minimum free air path of about three-eighths of an inch between the lips of the slip rings via the slip joint between the housing guide ring 56 and the rotor lip 60. It will be appreciated that the concept of arranging the brushes within the slip rings and on opposite faces of an insulating wall is one of the primary features of the construction giving rise to the above mentioned benefits.

While the present description illustrates the use of two receptacles to support both ends of a fluorescent lamp and to supply power to the four pins, it will be appreciated that other applications exist for a device of this type in which only two power contacts would be required and in which a single rotary receptacle at one end of the rotating electrified element would suffice.

I claim:

1. An electric receptacle comprising:
an annular nonrotating housing;
a rotor within the housing comprising a disk dividing the housing into two substantially noncommunicating compartments;
a brush on each face of the disk within its individual compartment including integral contactor means for making electrical contact with a rotary device; and
a slip ring in each compartment surrounding the corresponding brush and contacted by the same on its radially inward surface.

2. A receptacle as set forth in claim 1 in which each slip ring is formed with an axially extending cylindrical ring portion for contact with its brush which portion is of significantly smaller diameter than said disk, and an outwardly extending radial guide flange for loosely centering the slip ring within the housing, the radial flange being positioned at the side of each slip ring remote from the disk.

3. A receptacle as set forth in claim 1 in which the housing is provided with exterior projections designed for cooperation with fixed track means to provide for floating non-rotary motion of the housing when required.

4. A receptacle as set forth in claim 1 which further includes closure disks for the housing and in which the closure disks are attached to opposite ends of the rotor and fit against the faces of the annular housing to close the end openings thereof.

5. A receptacle as set forth in claim 1 in which each face of the disk is provided with a raised island dimensioned to lie substantially within the corresponding slip ring, which island is provided with a slot, and in which the brush is frictionally held in place on the rotor by its contact with the slot walls.

6. A receptacle as set forth in claim 5 in which each brush is a portion of a combined integral brush and contactor element, presenting retaining sections for cooperation with the slot and two oppositely directed resilient brush sections for contact with the interior surface of the corresponding slip ring at substantially opposite sides thereof.

7. A receptacle as set forth in claim 6 in which the rotor is provided with two axial openings for receiving the connector of a rotary device to be electrified, and in which each integral brush and contactor element includes an integral contactor blade extending into one of said axial openings.

8. A receptacle as set forth in claim 1 in which the slip rings are a relatively loose fit within the housing, the housing includes a radial slot in line with each slip ring position, and each slip ring includes an integral tab for making exterior circuit connections and which lies within one of said slots to prevent rotation of its corresponding slip ring.

9. A receptacle as set forth in claim 6 in which the slip rings are a relatively loose fit within the housing and are approximately centered by the opposing contact of the two resilient brushes acting thereon.

* * * * *